US005752627A

United States Patent [19]

Vandromme et al.

[11] Patent Number: 5,752,627

[45] Date of Patent: May 19, 1998

[54] PUMP-TYPE MIXING AND SPRAYING DEVICE

[75] Inventors: Michel Vandromme, Brion; Charles Pileur, Noyon, both of France

[73] Assignee: Sanofi (société anonyme), Paris, France

[21] Appl. No.: 556,968

[22] PCT Filed: May 9, 1995

[86] PCT No.: PCT/FR95/00600

§ 371 Date: Dec. 7, 1995

§ 102(e) Date: Dec. 7, 1995

[87] PCT Pub. No.: WO95/30490

PCT Pub. Date: Nov. 16, 1995

[30] Foreign Application Priority Data

May 10, 1994 [FR] France ..... 94 05755

[51] Int. Cl.[6] ..... B67D 5/32

[52] U.S. Cl. ..... 222/137; 222/631; 222/321.7

[58] Field of Search ..... 222/4, 252, 321.2, 222/321.7, 631, 145.5, 255, 136, 137

[56] References Cited

U.S. PATENT DOCUMENTS

| | | | |
|---|---|---|---|
| 3,581,946 | 6/1971 | Meshberg | 222/136 |
| 3,860,150 | 1/1975 | Maier | 222/631 |
| 3,926,343 | 12/1975 | Kleiner | 222/145.5 |
| 4,179,049 | 12/1979 | Umstead | 222/321.7 X |
| 5,100,029 | 3/1992 | Meshberg | 222/631 X |
| 5,395,032 | 3/1995 | Fuchs | 222/631 X |

FOREIGN PATENT DOCUMENTS

| | | |
|---|---|---|
| 0 451 615 | 10/1991 | European Pat. Off. . |
| 0 613 728 | 9/1994 | European Pat. Off. . |

*Primary Examiner*—Gregory L. Huson
*Attorney, Agent, or Firm*—Rothwell, Figg Ernst, & Kurz

[57] ABSTRACT

A pump-type device for distributing or spraying a product has first and second chambers which receive the product and a distribution fluid (gas), respectively. First and second pistons pressurize the product and the distribution fluid in the chambers as the movable member of the pump assembly begins moving in a first (downward) direction, then distribution passageways are opened to allow discharge of the product and the distribution fluid. Reverse movement of the movable member allows a subsequent dose of the product and distribution fluid to refill the chambers. The device is particularly well suited for spraying of relatively viscous products.

9 Claims, 4 Drawing Sheets

5
11
9
128
92
122
120
42
123
44a
6
20
114b
68
52
1
66
64
114a
52a
J1
53
108
62
82
60
14
96
107
38
112
90
50
12
24
32
35
106a
34
106b
36
8
76
94
2
104
22
ℓ
110
48
26
28
10
44b
30
31

PUMP-TYPE MIXING AND SPRAYING DEVICE

FIELD OF THE INVENTION

The invention relates to pump-type distribution devices and, in particular, to such devices for distributing a product that is relatively viscous, e.g., cream, gel, or milk.

BACKGROUND OF THE INVENTION

Existing systems for distributing or spraying a product, e.g., by mixing the product with a gaseous fluid, do not provide optimum conditions of use and are not always convenient to use. For example, they are not necessarily suitable for distributing a relatively viscous product, particularly in the form of a spray, i.e., as a jet of fine drops. Additionally, when the spraying is carried out using pressurised gas at a high enough pressure to force the product and the gas towards the spray nozzle area, imperfect sealing—in particular, imperfect sealing of the fluid pressurisation chamber—can degrade the quality of, or even make impossible, spraying of the product.

Furthermore, the structure of existing spray pumps is often complex, giving rise to high production costs; they cannot usually be used in all positions; and they do not permit mixed distribution of products which can only be brought into contact at the moment of distribution, e.g., because of their composition or reactivity, while permitting simple and efficient structure.

SUMMARY OF THE INVENTION

Thus, an object of the invention is to provide a pump-type distribution device which includes a movable member that is mounted on a fixed member. The device includes a first chamber which communicates, by means of an inlet aperture for the product, with the container in which the product is contained. The inlet aperture can be closed selectively by first selective closing means. The device also has a second chamber which receives the product distribution fluid, e.g., a gas.

The movable member includes a first piston, which is supported by a tubular member, and a second piston. The movable member also has an external thruster for axial displacement of the first and second pistons in the first and second chambers, respectively. In a first, upward movement of the movable member for filling the chambers, the first selective closing means permit passage of the product from the container into the first chamber. In a second, opposite movement of the movable member to exert pressure on the contents of the two chambers, the first selective closing means closes the inlet aperture.

An axial rod is attached to the thruster and is mounted so as to slide inside the tubular member. This rod and the tubular member define first and second discharge passages which communicate at one end with the first and second chambers, respectively, and, at an opposite end, with a mixing area for output and distribution of the product, as mixed with the distribution fluid. The rod and the tubular member define, in two separate "cooperation areas," first and second valves which selectively open or close the first and second passages, respectively. According to the relative position of the rod inside the tubular member, the valves close the first and second passages during the first movement and open the first and second passages during the second movement, once the inlet aperture is closed.

The device according to the invention is particularly useful for spraying a product (in particular, a relatively viscous product) by means of a gas that is pressurised in the second chamber, even if there are slight leakages of gas from this chamber. This is because opening of the discharge passages is controlled not by the pressure of the gas, but by closing of the product inlet aperture and by the action of the first piston in the product chamber. Thus, satisfactory operation is ensured even at a gas pressure which is slightly lower than that determined to be appropriate for the device.

For structural simplicity and compactness, the fixed member may have a lower portion, the cross-section of which defines the first chamber. This lower portion may extend axially upward to include an upper portion with an upper cross-section that defines the second chamber. The tubular component passes through the second chamber in order to reach the first, where it terminates in the first piston. The tubular component also supports the second piston, which is disposed in the second chamber.

According to another feature of the invention, the device is suitable for distribution of one product with another product, which can be admitted to the second chamber. This would be used for substances that react when mixed together and which therefore may be brought into contact only at the time of use. In this case, the device preferably includes means for controlling admission of the second product such that, during the first movement of the movable member, the second product is admitted into the second chamber, and during the second movement of the movable member, the admission aperture of this second product is closed, preferably substantially simultaneously with the closing of the inlet aperture of the first or main product.

DESCRIPTION OF THE DRAWINGS

Other features and advantages of the invention will become apparent from the following description and the attached drawings in which.

DESCRIPTION OF PREFERRED EMBODIMENTS

Figure 1:
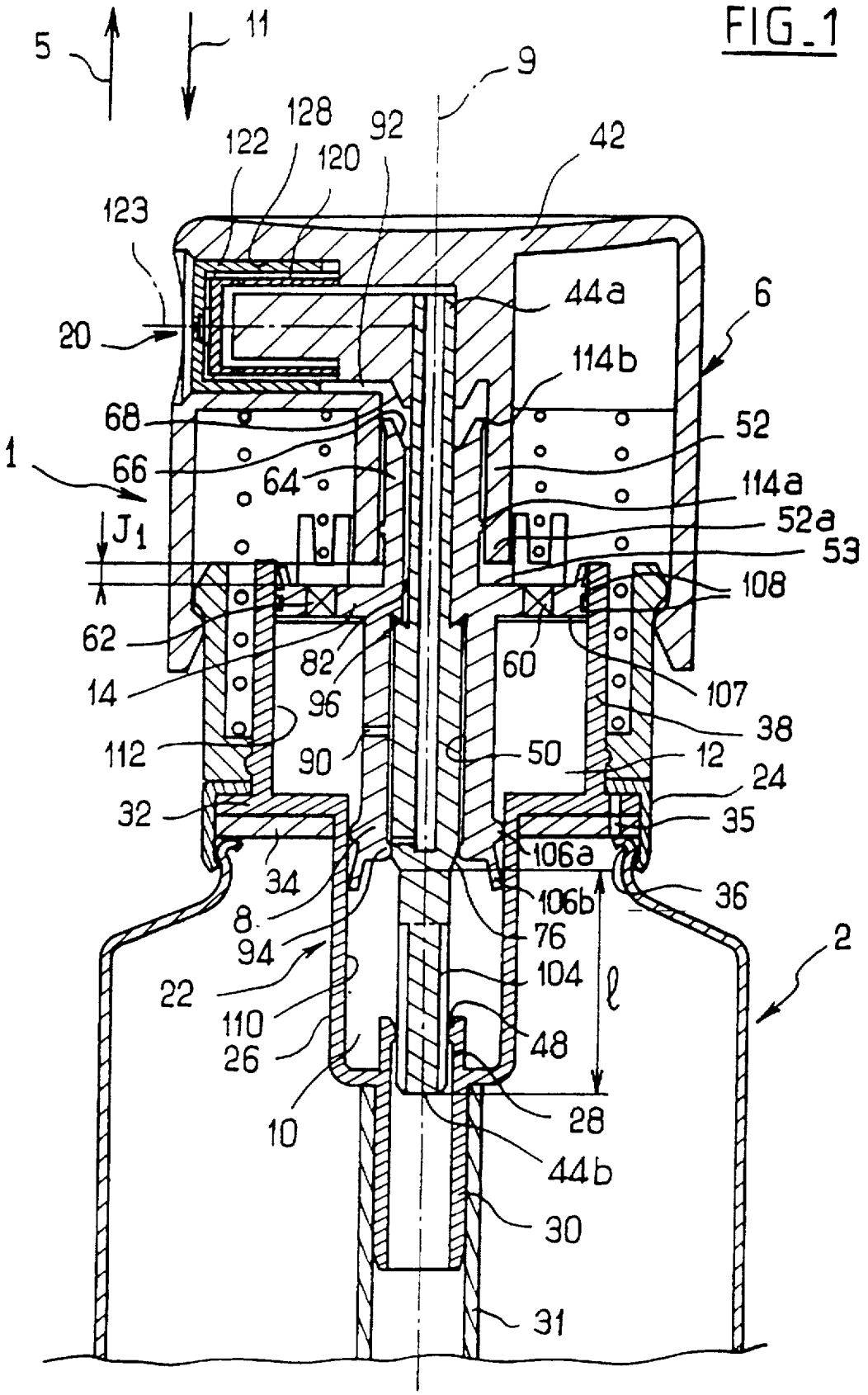
FIGS. 1–3 are median section views of a first embodiment of a pump-type distribution and spray device according to the invention in position on a container, these three Figures showing three different positions of the pump components and FIG. 2 being a more detailed view of the device.

FIG. 1 shows a pump spray device 1 for distributing measured amounts of a product that is very viscous, e.g., perfumed milk or cosmetic cream. Such a product can have a viscosity on the order of between 15,000 and 50,000 centipoise. The product is contained in a container 2 which, in particular, is a relatively flexible and deformable plastic bottle. The pump device has an inlet aperture or opening 4 which communicates with the container for the entry of product into chamber 10.

In order to be sprayed, the product is mixed with a gas in a mixing region 20 of the device 1. In particular, the gas may be atmospheric air.

The device 1 includes a pump system that has first and second selective control means for opening and closing the aperture 4 and discharge passages 16, 18 for the product and the distribution fluid (gas).

In general, by means of two pistons 8, 14 and the movable element 6, a first, upward movement of this pump system along axis 9 (in the direction of arrow 5) opens two chambers 10, 12 of variable volume. The first chamber 10, which communicates with the interior of the container 2, measures an amount of the product, and the second chamber 12 contains the fluid (gas) used to distribute the product. During this first, upward movement, the aperture 4 for filling the chamber 10 is maintained open by the first selective closing means, and the passages for discharging the product and the distribution fluid to the area 20 are closed.

In a second, downward movement of the movable element 6 (in the direction of arrow 11), the system exerts pressure on the product and the fluid by means of its pistons 8, 14. During this second movement, pressure of the piston 8 on the product is associated with closing of the aperture 4, thus preventing return of the product to the container. This causes—preferably virtually simultaneously—the discharge passages 16 and 18 to open. The product and the fluid are thereby forced to the output area 20, where they are mixed and the product is sprayed or otherwise distributed.

(In the rest of the description, the terms "upper" and "lower" will be used to refer to the opposite ends of the parts of the device, which is represented in a substantially vertical orientation for use.)

In the illustrated embodiment, the pump system, which is made essentially of plastics material, has a fixed or stationary member 22 that is connected to the container 2 by means of a clamping ring 24 which clamps the fixed member to the rim 36 of the container. The fixed member 22 has a lower portion 26 that is substantially cylindrical and which extends in the direction of axis 9. The lower portion 26 defines the chamber 10. At its bottom end, the portion 26 narrows inwardly to define the inlet aperture 4. The portion 26 has an axial neck 28 ending in a sealing flange 48 and extending into the chamber 10, and a short axial duct 30 extending away from the chamber 10 and connected to a flexible tube 31. The portion 26 is extended upwardly and outwardly by a collar 32. A seal 34 is sandwiched between the collar 32 and the rim 36 of the container, the collar being clamped to the rim by the clamp ring 24. A small aperture 35 (partially shown) is provided at this point for intake of air into the container.

Alternatively, the container 2 can communicate with the chamber 12 by means of a channel (not shown) which opens on one side into the chamber 12 and on the other side into the container. A valve to close this channel would be provided against the seal 34 on the container side to prevent air from returning to the pressure chamber. The channel would permit passage of some of the air contained in the chamber 12 into the container during the second movement of the movable member 6.

The fixed member also has an upper, cylindrical portion 38 with a cross-section that is larger than that of the lower portion 26. The upper, cylindrical portion 38 extends the collar 32 axially upward, above the portion 26. This portion 38 defines the second chamber 12, which can contain air and which preferably has a volume that is greater than that of the chamber 10. Thus, two concentric, axially offset chambers 10 and 12 are provided.

The movable member 6 includes, in essence, three parts: an outer thruster 42; a tubular member 46; and a substantially coaxial rod 44 which is fixed relative to the thruster and which slides relatively closely in the tubular member 46. The thruster 42, the lower part of which is hollow, surrounds and protects the system assembly down to the bottom of the portion 38. In its upper region, the thruster contains the mixing area 20, which opens to the exterior and which is extended locally and internally downwards by a hollow axial cylinder 52. The cylinder 52 communicates with the area 20 at its upper end and is open at its lower, free end **52*a* to accommodate, in a fluid-sealed manner, the upper end 44*a*** of the rod to which it is attached, e.g., by glue.

Preferably, the tubular member 46 has a slot 50 and comprises, towards its base, the lower piston 8. The piston 8 has a cross-section that is slightly larger than that of the tubular member and a relatively wide bearing surface which bears against the product. The piston 8 is mounted so as to slide in the chamber 10, which it separates from the chamber 12 in sealed fashion by means of seals or sealing lips **106*a*, 106*b* that slide along the surrounding guide wall 110**.

Preferably, the tubular member 46, which passes through the second chamber, forms the piston 14. The piston 14 consists of a collar which slides, sealed by seals 108, against the surrounding guide wall 112 of the cylindrical portion 38. This configuration of the tubular member 46, which forms the two pistons in the tiered chambers, is particularly compact and simple to manufacture and assemble. In an alternative configuration (not shown), the second piston can be formed integral with the thruster, the tubular member then being connected to the thruster by means of a spring.

The collar 14, which has a radially enlarged cross-section, has one or more apertures 60, 62 for intake of ambient air (distribution fluid) into the chamber 12. Air filtering components preferably are provided in the apertures 60, 62 to prevent contamination or deterioration of the product in the container, which would occur when air passes between the chamber 12 and the interior of the container 2. Selective closing means for the apertures 60, 62 are provided, for example, by a ring seal 107, which covers or moves away from the apertures 60, 62 depending on the movement of the movable member 6 to permit filling of or to seal the chamber 12.

As shown, the tubular member 46 is extended above the collar 14 by an upper cylindrical section 64, which surrounds the rod and slides in the cylinder 52. The upper section 64 is sealed by ring seals **114*a*, 114*b*. The end surface 66 of the section 64 cooperates with surface 68, opposite the cylinder 52, such that when these surfaces are drawn close to one another, a passage 40 is maintained for the distribution fluid to flow toward the spray or mixing area 20. At this point, the surface 68 abuts the extension area 52 near where the rod is disposed and where the section 64** slides.

The rod, which passes through the two chambers, preferably terminates in an end portion 78 (in this case solid) which slides within the aperture 4 to open it or to close it in a sealed manner. Thus, the end portion 78 constitutes first selective closing means for the aperture 4.

The portion 78 has a length 1 and a diameter that is substantially the same as the diameter of the aperture 4. It further has along part of its length one or more longitudinal grooves 104 which extend from the lower end **44*b* of the rod. This sliding end portion 78 advantageously permits use of the pump device in any position. The rod also has a bearing surface 76 which abuts the flange 48 to stop the movable member 6** at the bottom of its stroke.

Together, the rod 44 and the tubular member 46 define the passages 16 and 18. The discharge passage 18 for the distribution fluid is formed as an axial space 82 between the rod 44 and the tubular member 46. This space 82 is defined along its upper lengths by a groove 81 extending axially along the wall of the slot 50 from the surface 66. Groove 81 communicates with channel 92, formed in the thruster for discharge of the fluid as far as the jet area 20, via the passage 40. Along the lower part of the axial space 82, the space 82 consists of a slight amount of radial "play" J resulting from the difference in diameter between the rod 44 and the slot 50. At its lower end, the passage 18 communicates with the chamber 12 through aperture 90. Aperture 90 is formed in the wall of the tubular member 46 above the piston portion 8 of the tubular member 46.

The product discharge passage 16 is defined, in part, by an inner duct 70 extending along part of the length of the rod. At the end 44*a* of the rod, duct 70 opens into a channel 74 formed in the thruster for discharge of product towards the area 20. This substantially axial duct 70 is "elbowed" at its lower end and terminates at an aperture 72, which is provided in the wall of the rod above the bearing surface 76. Depending on the position of the rod within the slot 50, aperture 72 is either withdrawn inside the tubular member 46 or is displaced from it axially so as to open into the chamber 10. A gasket 113 is provided between the rod and the slot 50, above the aperture 72, to close the space 82 and seal the passages 16 and 18 from each other.

The rod 44 and tubular member 46 additionally form first and second valves 94 and 96, which constitute the second selective closing means for the passages 16 and 18. These valves consist, respectively, of regions 98, 100 which extend across the passages 16 18 and which cooperate with the rod 44 and the tubular member 46. Preferably, the valve 94 consists quite simply of the aperture 72 and the portion 102 of the tubular member wall against which aperture 72 slides. A seal 115 is provided on this portion 102.

Preferably, the second valve 96 is formed by abutting surfaces 80 and 84, which form the valve and valve seat at the junction between the groove 81 and the space 82. These complementary surfaces 80 and 84 consist, respectively, of two shoulders, one being formed on the outer wall of the rod and one being formed on the inner wall of the member 46, the shoulder 80 formed on the rod being inclined downwards in the direction of the axis of the rod.

A slight amount of axial "play" $J_1$ is provided between stop surface 52*a* of the thruster and the complementary stop area 53 of the tubular member 46.

In order for the member 46 to be maneuvered by the thruster and the play $J_1$ to be maintained over part of the movement of the movable member 6, flexible means such as helical spring 116 are provided. The spring is axially oriented in the inner volume of the thruster and is bounded by the thruster on one side and the piston 14 on the other. The stiffness of the spring 116 is selected such that the spring is compressed by pressure exerted on it (for example, at least 0.5 bar, which can be increased to approximately 3 or 4 bars) that is greater than or equal to the pressure actually exerted on it, when the aperture 4 closes, by the pressurised gas in the chamber 12 acting through the piston 14.

It will be appreciated that the pressure of the gas when the aperture 4 closes is a function of the viscosity of the product and the volume of the product to be sprayed, and will also depend on the path travelled by the pistons before the aperture 4 closes. Preferably, this pressure will remain substantially constant during most of the time of discharge of gas to the jet area 20.

The mixing area 20 has two coaxially nested, cup-shaped tubular parts 120, 122, each of which is closed by an end wall 124, 126, respectively. A generally annular recess 128, which opens to the exterior, is provided in the thruster to accommodate closely the parts 120, 122 along axis 123. Axis 123 is substantially perpendicular to the axis 9 for lateral distribution of the product, but other distribution orientations are possible as well.

Annular space 121, defined by the inner part 120 and the thruster, extends the channel 74 for intake and circulation of the product in the mixing or spray area 20. Two holes 132, 134 are provided in the wall of the cup-shaped part 120, just before its end wall 124, and bring the product and the fluid into contact with each other. The holes 132, 134 open substantially perpendicularly into two longitudinal channels or grooves 136, 138, which are defined between the cup-shaped parts 120, 122 and extend the channel 92. Grooves 136, 138 are further extended along the end wall 124 and merge together at central area 140. Preferably, the cross-section of the grooves 136, 138 decreases from the holes 132, 134 towards the area 140. An outlet aperture 142 is provided in the wall 126, opposite the area 140, for expulsion of the product/fluid mixture. Preferably, the outer aperture has a cross-section which decreases in the direction of output of the mixture.

For automatic return of the movable member 6 to the high position (first movement), at least one spring 144 can be provided in an annular recess 150 formed around the exterior of the bottom of the portion 38. Spring 144 is supported on one side on the bottom of the recess 150 and on the other side against an inner wall of the thruster.

Figure 2:
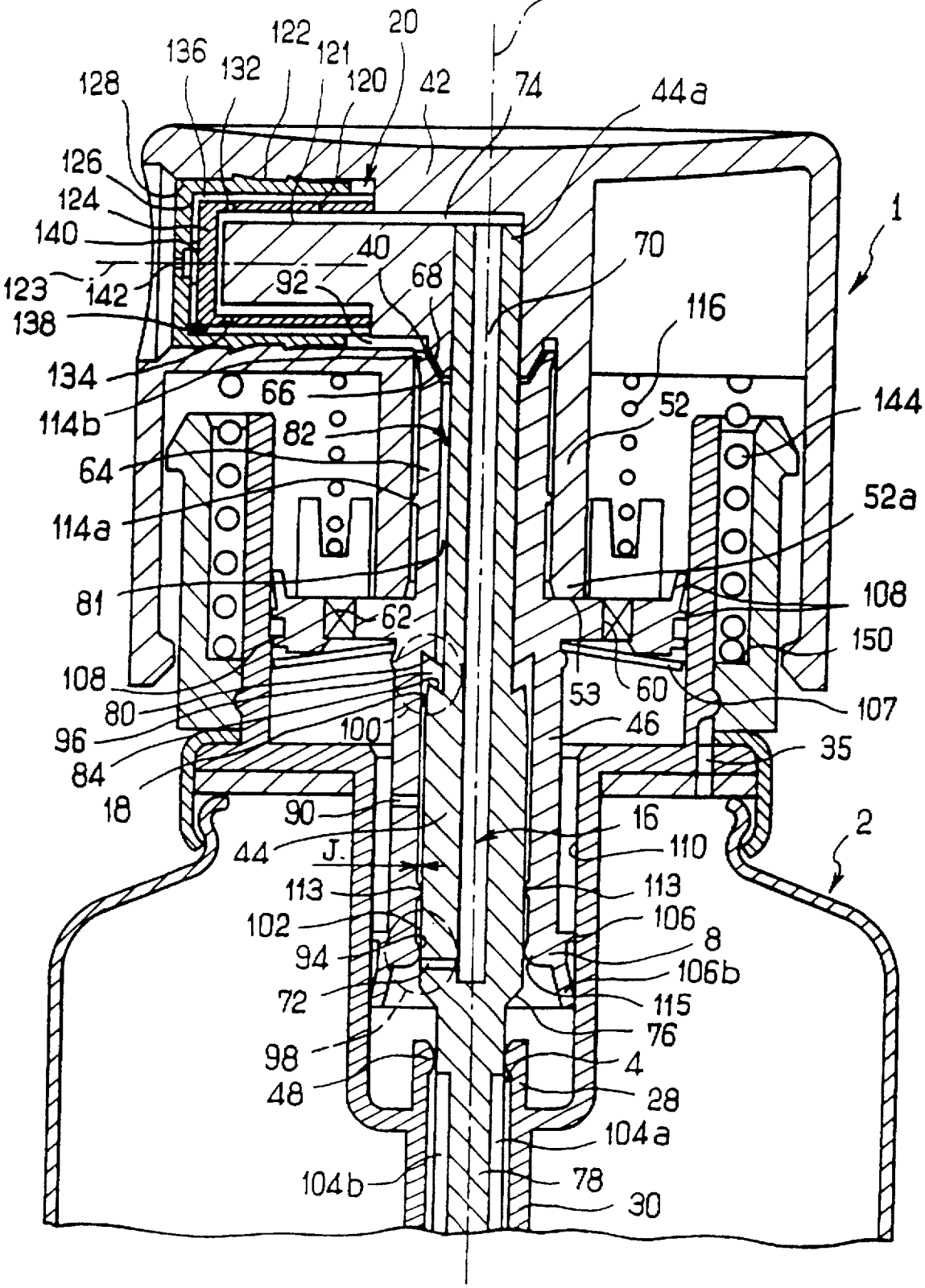
Figure 3:
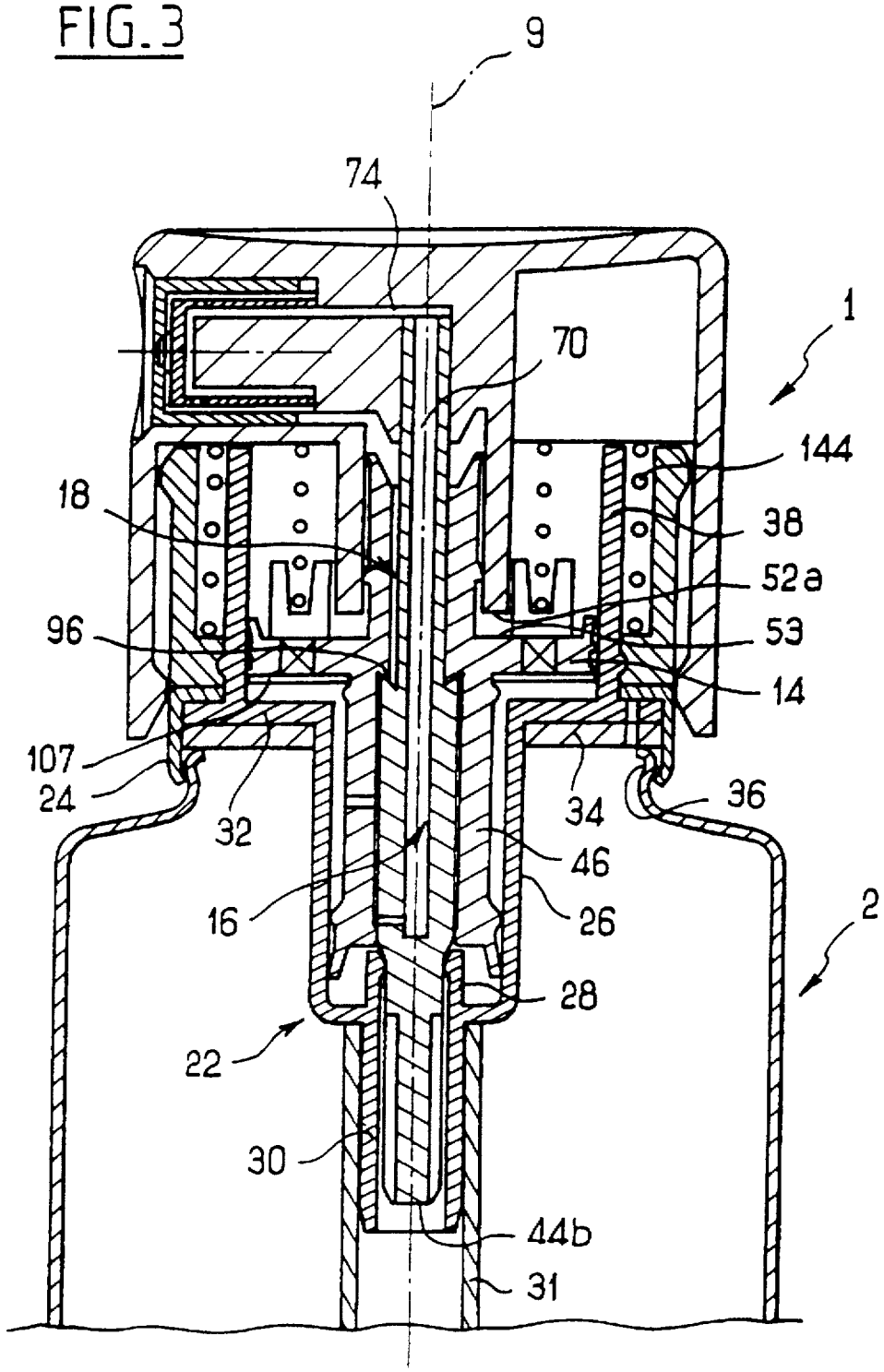

Briefly, the device shown in FIGS. 1 to 3 functions as follows. The movable member 6 is first in the high position, as shown in FIG. 1, and the chambers 10 and 12 are assumed to be full, with maximum volume. Pressing downward on the thruster 42 (arrow 11) causes the rod and the member 46 to move downward, thrust by the spring 116. Aperture 72 provided in the tubular member 46 remains closed and aperture 4 remains open as product passes into the grooves 104. Valve 80 remains seated against the seat 84, and the apertures 60, 62 are closed by the seal 107. The chamber 12 is thus sealed.

As downward movement of the movable member 6 continues, the pistons are displaced along axis 9 and exert pressure on the contents of the two chambers. This causes part of the product to return towards the interior of the container 2 and pressurisation of the fluid (gas). When the non-grooved part of the portion 78 of the rod closes the aperture 4, the gas has substantially attained the pressure required for spraying the product. Furthermore, the product is retained in the chamber 10, which is fully closed, and exerts counter-pressure on the piston 8, which is temporarily immobilised with the member 46.

Since the user continuously exerts pressure on the thruster throughout the second movement, the rod and thruster are displaced relative to the member 46 as the spring 116 is compressed and the play $J_1$ is taken up. This opens up communication between each chamber and its respective discharge passage as the valve 80 moves away from its seat 84 and as the aperture 72 slides down into a position in which it opens into the chamber 10.

Preferably, the communication aperture between the chamber 12 and the passage 18 opens shortly before the passage 16 and the chamber 10 are allowed to communicate with each other. As shown in FIG. 2, when the communication apertures are opened, the aperture 90 is preferably disposed in the reduced cross-section portion 26 to increase the speed of the gas through its discharge passage.

As downward movement of the movable member continues, the discharge passages 16, 18 are held open by the counter-pressure exerted at all times by the product on the tubular member 46 and the aperture 4 remains closed. The product is forced through its passage 16 (aperture 72, duct 70, then channel 74) towards area 20, as is the gas in its passage 18 (aperture 90, space 82, passage 40, then channel 92) which is then mixed with the product in the area 20. The gas aspirates the product by Venturi effect, which results in a spray of very fine drops that are projected externally. Preferably, the dimensions of the passages 16 and 18 decrease from the chambers 10, 12 towards the area 20.

When the bearing surface 76 of the rod abuts the neck 28, the thruster and the rod are stopped in the low position (FIG. 3) at the end of the stroke. Product which is still present in the chamber exerts pressure on the member 46, which acts against the spring 116 to maintain the communications open. Pressurised gas that is still in the chamber 12 aspirates product that is still in the passage 16 and the chamber 10. As this residual product is discharged and the pressure of the gas in the chamber 12 falls, the tubular member 46 slides downward relative to the rod, pushed in part by the spring 116. Preferably, the aperture 72 closes while the valve 96 is still open, thereby assisting aspiration of the residual product.

When communication between the area 20 and the chambers 10, 12 (minimum volume) is closed off, and when the user stops pressing the thruster, the return spring 144 pushes the movable member 6 back up in its rising movement. The member 46 is pulled up by the rod, by means of the valve seat 84, and by the spring 116. This draws product into the chamber 10, when the grooves 104 are positioned outside of the aperture 4, and permits intake of air in the chamber 12 by displacement of the ring 107 from the apertures 60, 62. (If no return spring is provided, the movable member remains in the low position and must be raised manually by the user.) When the movable member returns to the high position, the device 1 is ready to spray another dose of the product.

Figure 4:
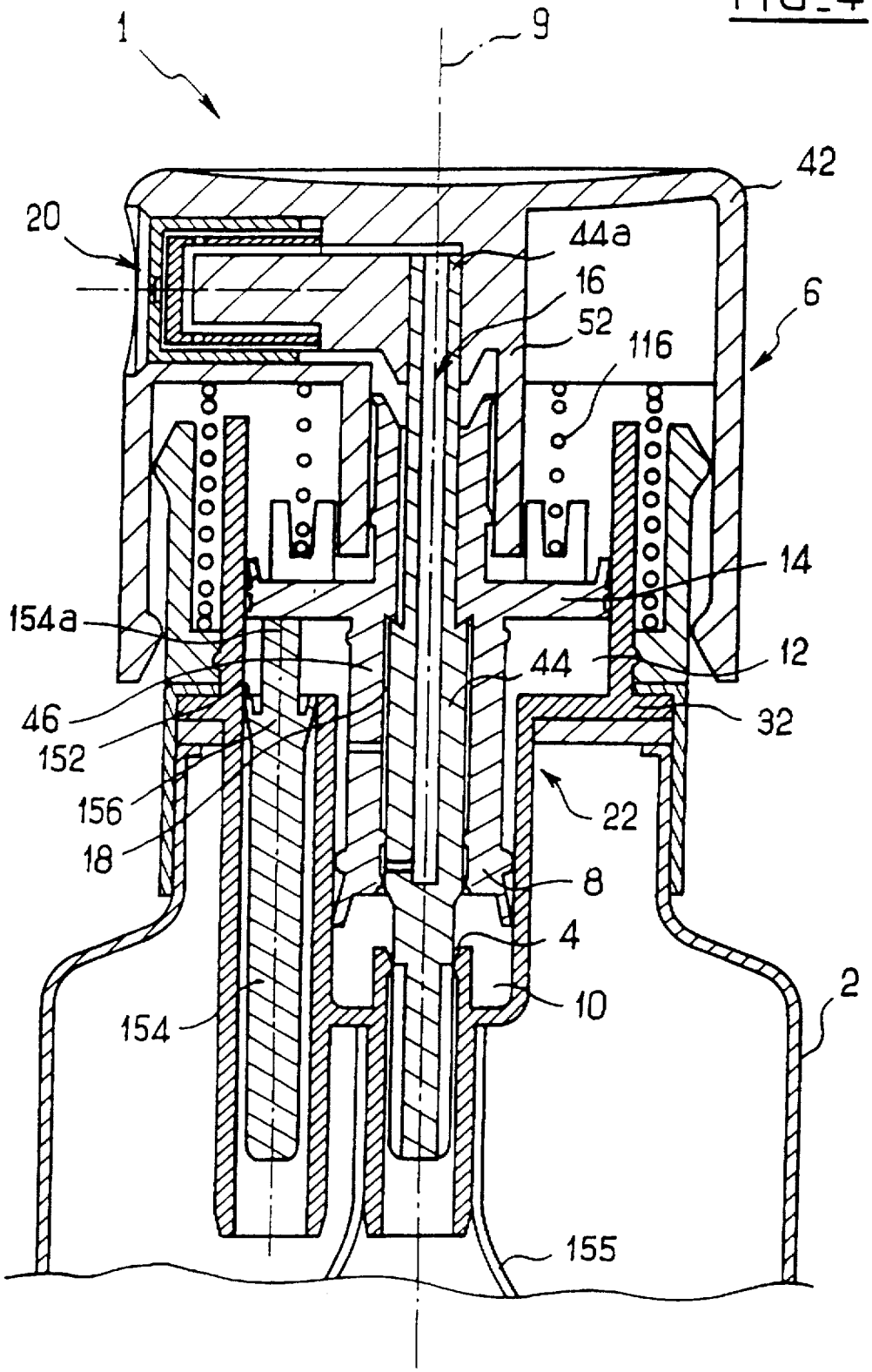
FIG. 4 is a median section view of an alternative embodiment of the pump-type spray device shown in FIGS. 1 to 3.

FIG. 4 shows an alternative embodiment for mixing and simultaneous distribution of two products, e.g., two fluids which are relatively viscous and which react with each other when mixed. The major difference in this embodiment is that the chamber 12 does not communicate with ambient air but, rather, with a source of a second product. Thus, the chamber 12 includes an inlet aperture 152 for the second product, in this case formed by the collar 32. Preferably, the container 2 holds the two products separately, one of them being contained, for example, in a deformable pouch 155. The device additionally includes third selective closing means for the aperture 152. The third selective closing means consists of an axial rod 154, which is attached at its upper end 154*a* to the piston 14 and which moves with the piston 14 and slides through the aperture 152. This rod 154, which has a diameter that is smaller than that of the aperture 152, has an outer truncated ring 156 which closes the aperture 152 in a sealed manner.

When the movable member is pressed downwards, the chambers 10 and 12 being assumed to be full, the rods 44 and 154 slide in the apertures 4 and 152, respectively, thereby allowing part of the two products to return to the container. (Alternatively, the apertures 4 and 152 can be closed at the beginning of the second, downward movement.) When the rods 44 and 154 close apertures 4 and 152, respectively (preferably virtually simultaneously), the tubular member 46 slides relative to the rod 44, thus opening the communication passages (by elimination of the play $J_1$) for discharge of the two products. The products are forced to the area 20 where they are mixed before emerging from the device.

When the movable member is in the low position, once the user stops pressing the thruster, the spring 116 return the movable member and the tubular member to the high position, thereby blocking communication between each chamber 10, 12 and its discharge passage 16, 18. Raising of the movable member to its high position also permits filling of the two chambers.

We claim:

1. Device for distributing a main product contained in a main product container, mixed with a main product distribution fluid, said device having an axis and comprising:

a mobile part which is mounted on a fixed part in order to delimit a first chamber which communicates with the main product container through an inlet aperture for the product, said inlet aperture being selectively closed by first selective closing means, and a second chamber for the main product distribution fluid, the mobile part comprising:

a first piston attached to a tubular component and disposed in the first chamber, and a second piston disposed in the second chamber, an external thruster for axial displacement of the first and second pistons in the first and second chambers, respectively, whereby in a first movement for filling the chambers, the first selective closing means permit passage of the main product from the container to the first chamber; and in a second, reverse movement, the pistons exert pressure on the contents of the chambers, the first selective closing means then closing the inlet aperture, an axial rod which is fixed to the thruster and which is disposed so as to slide inside the tubular component, said rod and said tubular component defining locally first and second discharge passages which communicate at one end with the first and second chambers, respectively, and at another end with a mixing area for output of the main product mixed with the main product distribution fluid, the rod and the tubular component comprising first and second valves interposed at two separate areas of the first and second passages, respectively, so as to close the first and second passages during the first movement and to open said first and second passages during the second movement, once the inlet aperture is closed, as a function of the relative position of the rod within the tubular component.

2. Device according to claim 1, wherein the fixed part comprises a lower portion having a cross-section delimiting the first chamber, said lower portion being extended axially by an upper portion with an upper cross-section delimiting the second chamber, and wherein the tubular component passes through the second chamber in order to reach the first chamber where said tubular component terminates in the first piston, the second piston being disposed in the second chamber and being attached to said tubular component.

3. Device according to claim 1 wherein the rod contains a substantially axial duct positioned for communication with the first chamber and defining, in part, the first passage for the main product, the first chamber and the first passage being adapted to communicate as a function of the position of the rod relative to the tubular component, said adaptation defining the first valve, wherein a space adjoining the second chamber is provided between the rod and the tubular component to define locally the second passage for the main product distribution fluid; and wherein complementary shoulders formed on the rod and on the tubular component define the second valve.

4. Device according to claim 1, wherein the rod comprises an axial end part which slides through the inlet aperture for the product, thereby forming said first selective closing means.

5. Device according to claim 1 wherein the first discharge passage terminates in an aperture which, at the end of the second movement, closes communication between the first discharge passage and the first chamber before the second valve closes the second passage for the distribution fluids, whereby the distribution fluid aspirates main product remaining in the first passage.

6. Device according to claim 2, further comprising flexible means, supported at one end by the second piston and at another end by the thruster, for maneuvering of the tubular component by the thruster, said flexible means adapted to be compressed by pressure exerted thereon which is greater than or equal to pressure exerted by the distribution fluid during the second movement.

7. Device according to claim 2 wherein the second discharge passage terminates in an aperture which, during the second movement, is displaced in the lower portion of the fixed part to convey the distribution fluid thereto.

8. Device according to claim 1, wherein the distribution fluid is air and the second chamber receives atmospheric air through at least one aperture adapted to be blocked during the second movement and opened during the first movement.

9. Device according to claim 1, wherein said distribution fluid is a viscous product and the second chamber communicates with a source of said viscous product through an inlet aperture, the device further comprising selective closing means for said viscous product inlet aperture to permit passage of said viscous product into the second chamber during the first movement of the mobile part and to close the inlet aperture for said viscous product during the second movement of the mobile part.

* * * * *